US006703913B2

(12) United States Patent
DeCormier et al.

(10) Patent No.: US 6,703,913 B2
(45) Date of Patent: Mar. 9, 2004

(54) COAXIAL LINE PHASE STABILIZATION ASSEMBLY AND METHOD

(75) Inventors: William A. DeCormier, Poland, ME (US); Cole N. Plummer, South Casco, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/838,542

(22) Filed: Apr. 20, 2001

(65) Prior Publication Data

US 2002/0153975 A1 Oct. 24, 2002

(51) Int. Cl.[7] ..... H01P 5/00; H01Q 1/18
(52) U.S. Cl. ..... 333/245; 343/890; 343/891
(58) Field of Search ..... 333/248, 245; 343/890, 891, 892; 248/68.1

(56) References Cited

U.S. PATENT DOCUMENTS 2,708,686 A * 5/1955 Bernard, Jr. et al. .... 393/890 X
4,342,474 A * 8/1982 Sewell et al. ..... 343/891 X
4,654,612 A * 3/1987 Smith ..... 333/248

* cited by examiner

*Primary Examiner*—Benny Lee
(74) *Attorney, Agent, or Firm*—Baker & Hostetler LLP

(57) ABSTRACT

An apparatus and method stabilizes a pair of parallel coaxial lines for an antenna having a tower. An upper portion of each coaxial line is suspended from the tower. A lower end of the coaxial lines is free to move vertically relative to the tower. The apparatus has a flexible section disposed along a first portion of the length of one coaxial line and a frame which rigidly ties together the two coaxial lines at a second portion of each of the lines below the flexible section.

20 Claims, 3 Drawing Sheets

COAXIAL LINE PHASE STABILIZATION ASSEMBLY AND METHOD

FIELD OF THE INVENTION

The invention relates to an arrangement to stabilize two parallel coaxial lines, such as for example signal lines extending vertically and supported by a transmission tower.

BACKGROUND OF THE INVENTION

It is known in antenna systems to have two parallel coaxial lines extending vertically upwards along the tower. These coaxial lines each include, for example, up to 2,000 feet of coaxial tubing in sections, forming a coaxial line fixed to the tower at the top of the line, so that the line is suspended from its top end.

Both coaxial lines may be suspended at points along their length by spring hangers from the tower to allow the coaxial lines to expand and contract with respect to the tower. The spring hangers provide stability while permitting vertical travel of the line relative to the tower due to factors such as thermal expansion of the line relative to the tower. Temperature variations produced by weather and the operating power of the coaxial line cause the coaxial lines to expand at a different rate than the tower. The coaxial line and the tower are also made of different materials, further contributing to differential expansion between the lines and the tower. For example, the coaxial line may be made of copper and the tower made of steel. Since these two metals have different coefficients of expansion, there is a differential in the thermal growth of the copper coaxial line with respect to the steel tower as temperature and power changes.

For this reason, it is known to suspend the coaxial lines from the top of the tower, so they are fixed both vertically and horizontally at the top of the coaxial line to the tower, but are essentially hanging in a suspended state from the top, with the lines being horizontally restrained by spring hangers that permit vertical movement along the length of the line. This permits the length of the line to have vertical travel, and the lower end of the coaxial lines, which usually terminate in an elbow connecting to a horizontal coaxial line section, are free to travel vertically relative to the tower.

A disadvantage of the known arrangement is that one of the two parallel coaxial lines may expand at a different rate than the adjacent coaxial line. For example, if one coaxial line is heated by the sun and the other coaxial line is in the shade, the first coaxial line will expand at a different rate than the second coaxial line. The differential in the relative linear expansion between two adjacent coaxial lines can cause a phase difference in the transmission of signals transmitted through the lines, which can result in undesirable beam tilt when the signal reaches the antenna. That is, if the two coaxial lines expand by different degrees along their length, the distance from the lower elbow to the fixed top portion of the line for each line will be a different total distance. Therefore, if one line elongates more than the other adjacent line, the effective and actual transmission length of the two lines will be different. Because these two lines are intended to carry signals that are at a fixed relative phase at the elbows in the lower portion of the lines, the change in length is undesirable because the signals at the top of the coaxial lines will become out of phase due to their having traveled a different distance.

Accordingly, there is a need for an arrangement that can tie together a pair of parallel coaxial lines and accommodate for differential expansion between sections of the adjacent lines while maintaining a constant relative total length between two points of the lines, such as for example, between a lower elbow and a fixed top end of each line.

SUMMARY OF THE INVENTION

It is therefore a feature and advantage of the present invention to provide an arrangement that can tie together a pair of parallel coaxial lines and accommodate for differential expansion between sections of the adjacent lines while maintaining a constant relative total length between two points of the lines, such as for example, between a lower elbow and a fixed top end of each line.

The above and other features and advantages are achieved through the use of a novel apparatus as herein disclosed. In accordance with one embodiment of the present invention, an apparatus is provided for stabilizing a pair of parallel coaxial runs in an antenna having a tower. An upper portion of each coaxial line is suspended from the tower, and a lower end of the coaxial lines is free to move vertically relative to the tower. The apparatus comprises a flexible section disposed along a portion of the length of one coaxial line and a frame which rigidly ties together the two coaxial lines at a portion of the lines below the flexible section.

In another aspect, the invention provides an apparatus as described above, where the portions of the lines which are tied together are elbows.

In yet another aspect of the invention, an apparatus is provided where the frame ties together the portions of the coaxial lines so that they are retained in a common horizontal plane.

In yet another aspect of the invention, the frame includes a cross member that is strapped to each of the second portions of the lines.

In still another aspect of the invention, an apparatus is provided where the frame further includes a stabilization assembly that surrounds the first coaxial line at a position above the flexible section and permits vertical travel of the coaxial line relative to the frame at the surrounded position, and inhibits lateral movement of the coaxial line at that position relative to the frame, thereby permitting the expandable element to expand and contract vertically, and inhibiting axial misalignment of the line above and below the flexible section.

Another aspect of the present invention relates to an apparatus having spring hangers each supporting one coaxial line from the tower so that the spring hangers permit vertical travel of the coaxial line relative to the tower and inhibit lateral movement of the coaxial line relative to the tower.

In accordance with another embodiment of the present invention, an apparatus is provided for stabilizing a pair of coaxial lines for an antenna having a tower, with an upper portion of each coaxial line being suspended from the tower, and a lower end of the coaxial lines free to move vertically relative to the tower. The apparatus has expanding means disposed along the first portion of one coaxial line, and tying means for rigidly tying together the two coaxial lines at a second portion of each of the lines below the expansion means.

In accordance with another embodiment of the present invention, a method is provided for stabilizing a pair of parallel coaxial lines in a tower. An upper portion of each coaxial line is suspended from the tower, and a lower end of the coaxial lines is free to move vertically relative to the tower. The method comprises the steps of providing an expandable element at a location between the upper portion and lower end of the coaxial line and holding the lower ends of the coaxial lines together at a relative horizontal height with each other.

In another aspect of the invention, the method includes the steps of permitting the lower ends to move vertically relative to the tower, while simultaneously holding the lower ends at the same height as each other.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED

Embodiments of the Invention

In general, according to the invention, two parallel coaxial lines are rigidly suspended from a position such as the top of an antenna tower. The coaxial lines each have an elbow at their base, leading to a horizontal coaxial line section. To permit for differential relative expansion between the coaxial lines, a flexible section or expandable element is provided between the upper fixed end of one of the coaxial lines and its corresponding lower elbow. The flexible section can expand and contract to accommodate relative differences in elongation. The lower elbows are tied together so they remain in the same horizontal location as each other.

Figure 1:
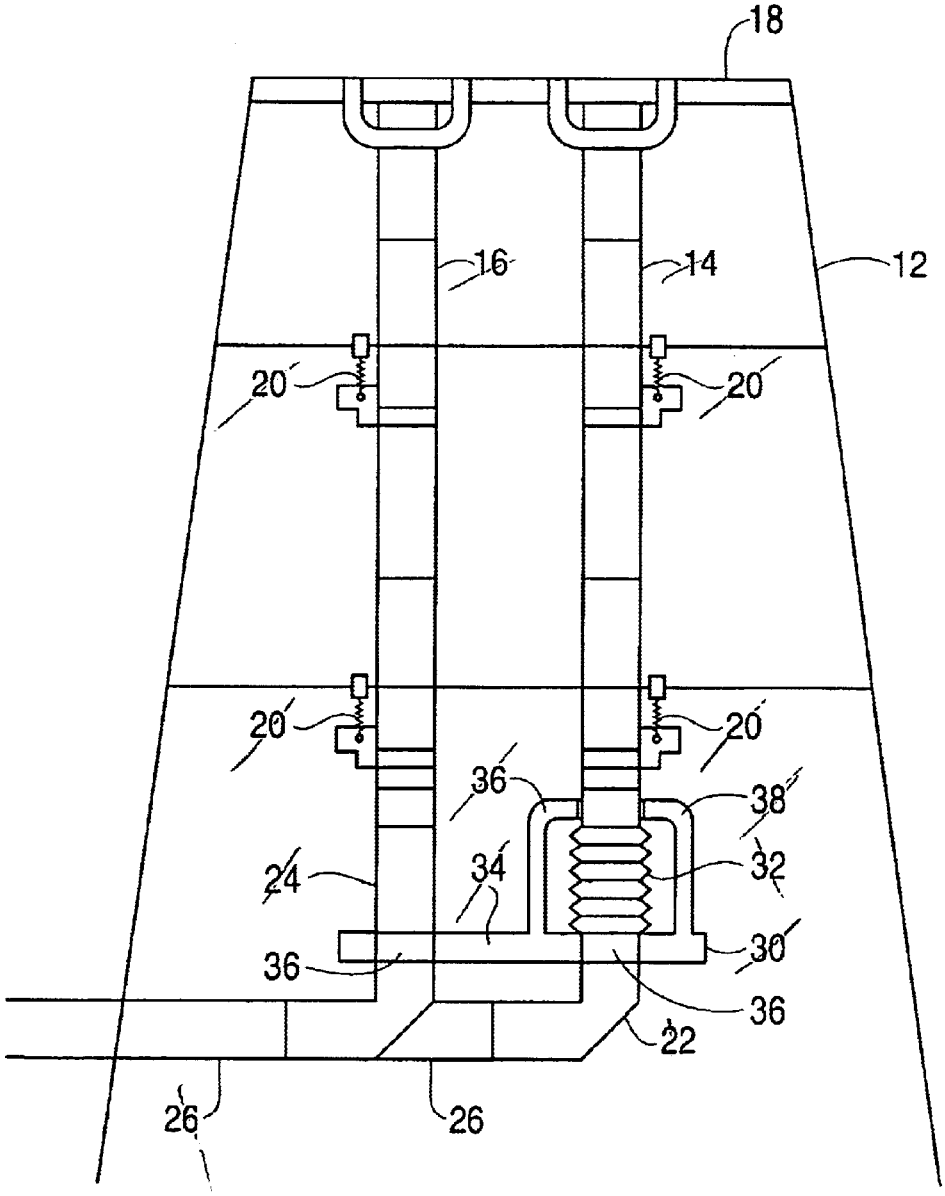
FIG. 1 is a schematic diagram of a tower arrangement having two parallel coaxial lines.

Referring to FIG. 1, a tower 12 is shown with coaxial lines 14 and 16 suspended therefrom. The coaxial lines 14 and 16 can each be made up of a plurality of sections, each having flanges at their ends and connected end to end by their flanges. The top of each coaxial line 14 and 16 is rigidly connected to a portion 18 of the tower 12. This connection fixes the top sections of the coaxial lines 14 and 16 so that they do not move vertically or horizontally. Along the length of the coaxial lines 14 and 16, they may be attached to portions of the tower by spring hangers 20. These spring hangers 20 permit vertical travel of the coaxial lines 14 and 16 relative to the tower members which the spring hangers are attached to.

The lower parts of the coaxial lines 14 and 16 each terminate in an elbow 22 and 24, respectively. In the embodiment shown, the elbows 22 and 24 are connected to horizontal coaxial line portions 26 and 28.

A frame 30 connects and ties together the vertical portions of the elbows 22 and 24 so that they remain horizontal to each other. Thus, although the frame 30 may move vertically relative to the tower, the two elbows 22 and 24 will travel together, and will always be at the same height or horizontal plane as each other. A flexible section or expandable element 32, which can expand and contract axially, is provided between the upper fixed end of one coaxial line 14 and its corresponding elbow 22.

The length from the top of both coaxial lines 14 and 16, including the flexible section 32, to their respective elbows 22 and 24, is made electrically and mechanically the same length for a given set of ambient conditions. Differences between the expansion of the coaxial lines, such as placement of the sunlight during operation that causes one coaxial line to grow at a different rate than the adjacent coaxial line, is compensated for by compression or expansion of the flexible section.

Thus, the combination of the flexible section 32 and frame 30 provides an advantage of the invention by which differential movement is accommodated, yet the total length of each coaxial line from top to elbow is maintained to be equal relative to each other, so that phase difference and beam tilt can be maintained below or within acceptable levels. Another advantage is that the ability of the lines to expand at a different rate than the tower remains, because the frame is effectively suspended together with the elbows.

In a preferred embodiment, the flexible section is manufactured from stainless steel and plated with high conductivity silver, and has a corrugated sidewall profile. The inner conductor 33, shown in FIG. 2, either is manufactured from stainless steel and plated with high conductivity silver and has a corrugated sidewall profile or utilizes a rigid copper tubing telescoping in another rigid copper tubing with a sliding contact to allow expansion and contraction in the axial direction.

Figure 3:
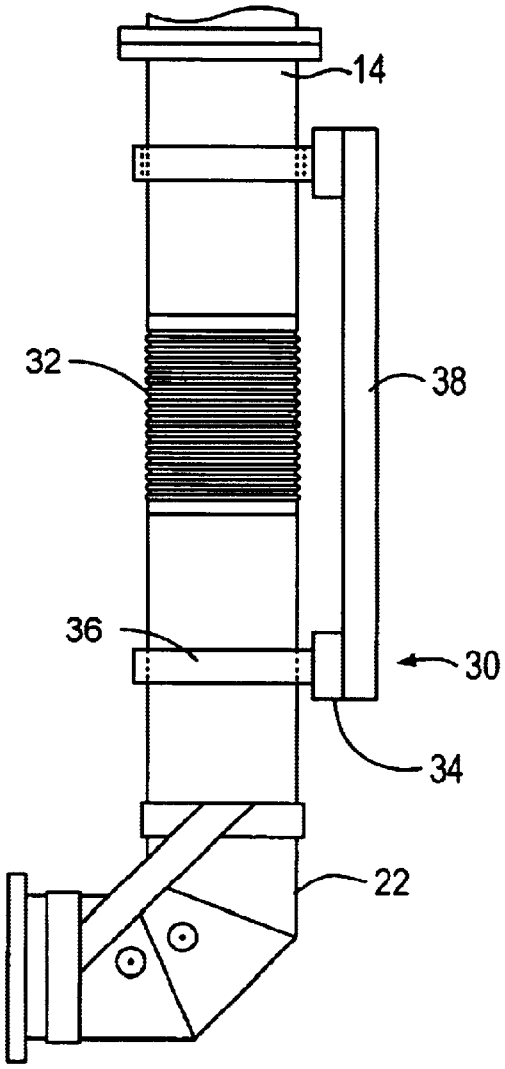
FIG. 3 is a left side view of the coaxial lines of FIG. 2.

Referring to FIG. 1, the frame 30 in a preferred embodiment comprises a cross bar portion 34 that is strapped to the upper portions of the elbows 22 and 24 by straps 36. This may be seen from the side in FIG. 3. In this way, the elbows 22 and 24 are tied together so that they cannot move vertically relative to each other, and hence the total effective length from the elbows to the top of the coaxial lines 14 and 16 remains equal. If a relative differential expansion is occurring between the segments along the length of coaxial lines 14 and 16, the difference in expansion will be taken up by expansion or contraction of the flexible section 32.

Figure 2:
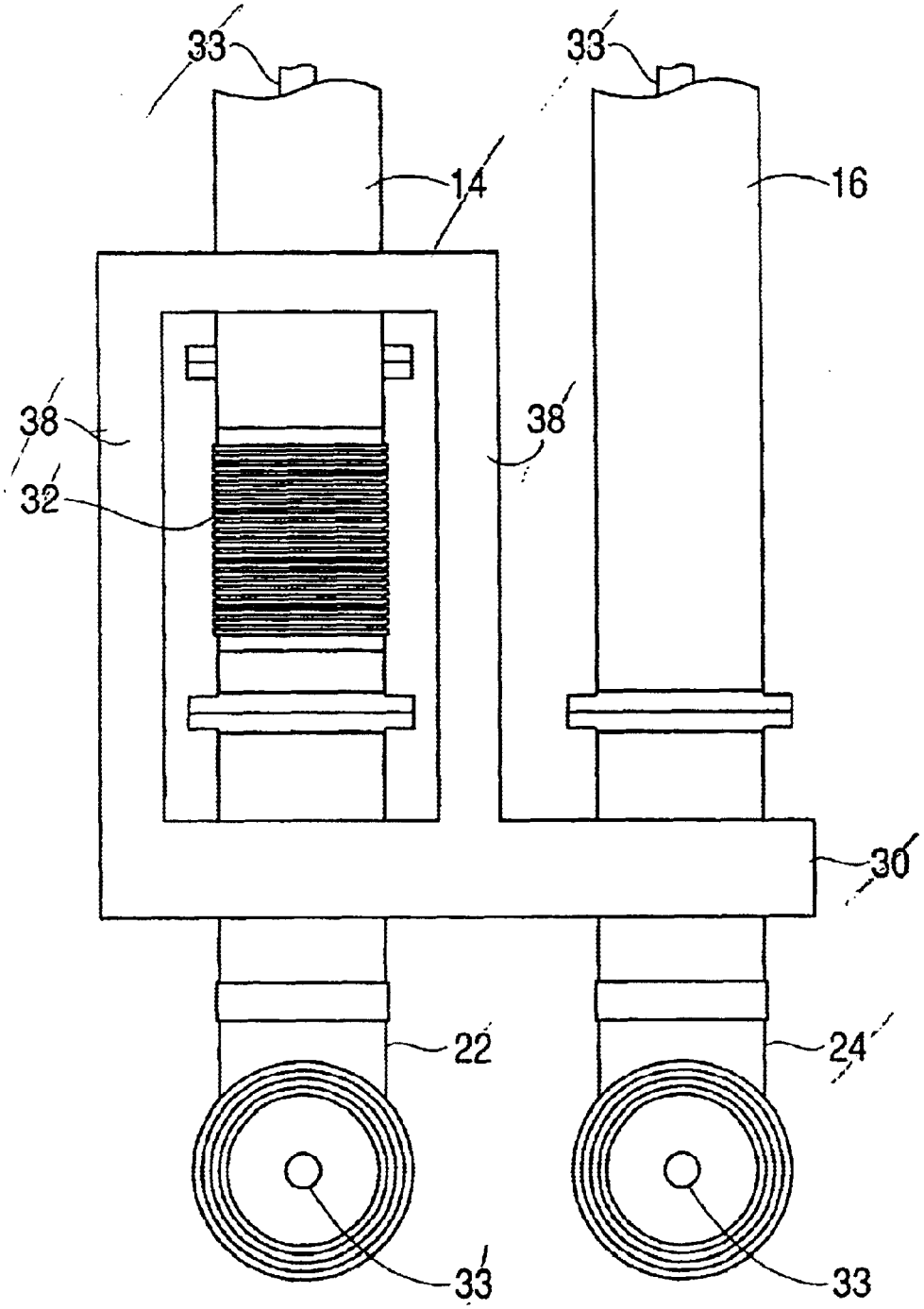
FIG. 2 is a side view of the lower portions of two parallel coaxial lines tied together.
Figure 4:
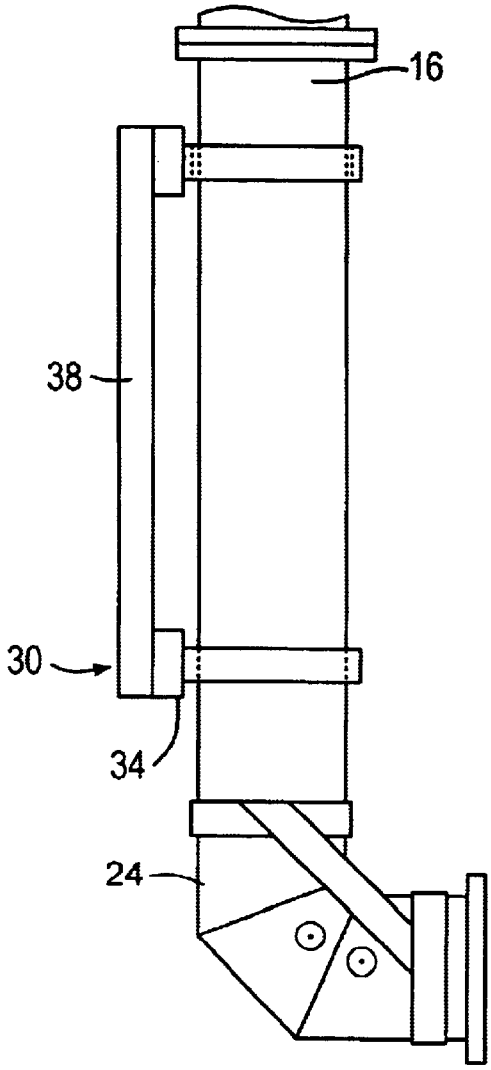
FIG. 4 is a right side view of the coaxial lines of FIG. 2.

Referring to FIG. 1 and FIG. 2, the frame 30 may also include a stabilization leg assembly 38 which extends upward from the frame 30 along the flexible section, without contacting the flexible section, and which has a sliding contact with the circumference of the segment of the coaxial line 14 located immediately above the flexible section 32. By virtue of this design, the leg stabilization assembly 38 permits the frame to restrict relative lateral, i.e., sideways motion at the flexible section, so that the flexible section provides for only vertical expansion or contraction. In this way, the coaxial line 14 and its elbow 22 remain in axial alignment. Alternate views of the configuration from both sides are presented in FIG. 3 and FIG. 4. wherein coaxial lines 14 and 16. elbows 22 and 24, frame 30, flexible section 32, crossbar portion 34, straps 36, and stabilization leg assembly 38 discussed above are shown again for added clarity.

Although a flexible section is described as the preferred example of an expandable element 32, other suitable expandable devices may be used. For example, the expandable element 32 on the inner and/or outer conductors may alternatively be a rigid copper tubing telescoping in another rigid copper tubing with a sliding contact to allow expansion and contraction in the axial direction.

Although the example described uses one flexible section and one frame, in some examples it is possible to use more than one flexible section and/or more than one frame along the length of a line.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for stabilizing a pair of parallel coaxial lines within a tower, with a topmost portion of each coaxial line being fixed to the tower, and a lower end of each coaxial line free to move vertically relative to the tower, the apparatus comprising:

an expandable element disposed in-line as part of a first portion of a first one of the pair of coaxial lines; and a frame rigidly tying together the pair of coaxial lines at a second portion of each one of the pair of coaxial lines below the expandable element of the first one of the pair of coaxial lines.

2. The apparatus according to claim 1, wherein the second portions of the pair of coaxial lines tied together each comprise an elbow.

3. An apparatus according to claim 2, wherein the frame includes a cross member that is strapped to each of the elbows of the pair of coaxial lines.

4. The apparatus according to claim 2, wherein the frame ties together the elbows of the pair of coaxial lines so that they are retained in a common horizontal plane.

5. An apparatus according to claim 1, wherein the frame includes a cross member that is strapped to each of the second portions of the pair of coaxial lines.

6. The apparatus according to claim 1, wherein the frame ties together the second portions of the pair of coaxial lines so that they are retained in a common horizontal plane.

7. An apparatus according to claim 1, wherein the frame further includes a stabilization assembly that surrounds the first one of said pair of coaxial lines at a position above the expandable element thereof and permits vertical travel of the first one of said pair of coaxial lines relative to the frame at the surrounded position, while inhibiting lateral movement of the first one of said pair of coaxial lines at that position relative to the frame, thereby permitting the expandable element to expand and contract vertically while inhibiting axial misalignment of the line above and below the expandable element of the first one of said pair of coaxial lines.

8. An apparatus according to claim 1, further comprising a multiplicity of spring hangers, each of which provides a portion of the suspension of one of the pair of coaxial lines from the tower at one of a multiplicity of locations along the vertical extent of the tower, whereby said spring hangers permit vertical travel of the coaxial line relative to the tower, and inhibit lateral movement of the coaxial line relative to the tower.

9. An apparatus according to claim 1, wherein the expandable element is corrugated.

10. An apparatus for stabilizing a pair of parallel coaxial lines for an antenna having a tower, with a topmost portion of each of the pair of coaxial lines being fixed to the tower, and a lower end of each of the pair of coaxial lines free to move vertically relative to the tower, the apparatus comprising:

expansion means disposed in-line as part of a first portion of a first one of the pair of coaxial lines; and means for rigidly tying together the pair of coaxial lines at a second portion of each of the pair of lines below the expansion means.

11. An apparatus according to claim 10, wherein the expansion means comprises a flexible section.

12. The apparatus according to claim 10, wherein the second portions of the pair of coaxial lines tied together each comprise an elbow.

13. An apparatus according to claim 12, wherein the tying means includes a cross member that is strapped to each of the second portions of the respective elbows of the pair of coaxial lines.

14. The apparatus according to claim 12, wherein the tying means ties together the elbows comprising the second portions of the pair of coaxial lines so that they are retained in a common horizontal plane.

15. An apparatus according to claim 10, wherein the tying means include a cross member that is strapped to each of the second portions of the pair of coaxial lines.

16. The apparatus according to claim 10, wherein the tying means ties together the second portions of the pair of coaxial lines so that they are retained in a common horizontal plane.

17. An apparatus according to claim 10, wherein the tying means further includes a stabilization assembly that surrounds the first one of the pair of coaxial lines at a position above the expansion means and permits vertical travel of the first one of the pair of coaxial lines relative to the tying means at the surrounded position, but inhibits lateral movement of the first one of the pair of coaxial lines at that position relative to the tying means, thereby permitting the expansion means to expand and contract vertically, while inhibiting axial misalignment of the first one of the pair of coaxial lines above and below the expansion means.

18. A method for stabilizing a pair of parallel coaxial lines for an antenna having a tower, with an upper portion of each of said pair of coaxial lines being fixedly suspended from the tower, and a lower end of each of the pair of coaxial lines free to move vertically relative to the tower, the method comprising the steps of:

providing, as a part of the first one of the pair of coaxial lines, an expandable element in-line at a location between the upper portion and the lower end of the first of the pair of coaxial lines; and holding the lower ends of the pair of coaxial lines together at a relative horizontal height with each other.

19. A method according to claim 18, further comprising the steps of permitting the lower ends of the pair of coaxial lines to move vertically relative to the tower, while simultaneously holding the lower ends of the pair of coaxial lines at the same height as each other.

20. A method according to claim 18, wherein the portions of the pair of coaxial lines tied together each comprise an elbow.

* * * * *